US005173337A

United States Patent [19]

Nelson

[11] Patent Number: 5,173,337

[45] Date of Patent: Dec. 22, 1992

[54] CONSTRUCTION PROCESS FOR SIMULATING A DESIRABLE APPEARANCE

[76] Inventor: David S. Nelson, 17 Parkway S., Aiken, S.C. 29801

[21] Appl. No.: 660,528

[22] Filed: Feb. 25, 1991

[51] Int. Cl.[5] ..... B05D 1/32; B44F 7/00

[52] U.S. Cl. ..... 427/282; 427/287; 52/314; 52/315

[58] Field of Search ..... 52/314, 315, 741, 743, 52/316; 427/282, 287

[56] References Cited

U.S. PATENT DOCUMENTS

| | | | |
|---|---|---|---|
| 2,095,642 | 10/1937 | Knight | 52/314 X |
| 2,266,510 | 12/1941 | Pottinger | 52/315 |
| 2,305,280 | 12/1942 | Strunk et al. | 52/314 X |
| 3,426,490 | 2/1969 | Taylor | 52/314 X |
| 3,524,790 | 8/1970 | Mason | 52/314 X |
| 3,991,529 | 11/1976 | Terwilliger | 52/314 X |
| 4,164,598 | 8/1979 | Wilhelm | 52/314 X |
| 4,275,540 | 6/1981 | Keller | 52/314 |
| 4,510,729 | 4/1985 | Syring | 52/315 X |

FOREIGN PATENT DOCUMENTS

| | | | |
|---|---|---|---|
| 7607128 | 3/1977 | Netherlands | 52/314 |

*Primary Examiner*—David A. Scherbel
*Attorney, Agent, or Firm*—Bailey & Hardaway

[57] ABSTRACT

A construction process and product thereof are provided which include affixing a construction medium simulating the appearance of solid stone to a construction frame to simulate a desirable appearance.

3 Claims, 1 Drawing Sheet

CONSTRUCTION PROCESS FOR SIMULATING A DESIRABLE APPEARANCE

BACKGROUND OF THE INVENTION

This invention relates generally to the construction environment and more particularly to a construction process to simulate a desirable appearance, particularly stone.

Methods for simulating a desirable appearance are common in the area of construction. A simulated surface that has the appearance of a natural solid medium is much less expensive and is often more practical. The prior art has therefore disclosed various methods of simulating a desirable appearance, especially to simulate a natural stone appearance.

U.S. Pat. No. 2,618,815 discloses a method for applying a plaster or cement coating to a wall by using a stone-shaped mold coated on its interior with a waxy solution and using small stone or stone-like particles. U.S. Pat. No. 2,810,180 also discloses a mold for applying stone-like materials to a wall. U.S. Pat. No. 4,146,599 discloses a method for applying exposed aggregate comprising loading the aggregate on a resilient facing material.

While all of these prior art techniques perform well for their intended purpose, room exists for further improvement in the art.

SUMMARY OF THE INVENTION

It is therefore an object of the present invention to provide a novel construction process to simulate a desirable appearance.

It is another object of the present invention to provide such a construction process that simulates the appearance of a solid stone structure with a natural weathered appearance.

It is still another object of the present invention to provide a building structure simulating the appearance of a weathered stone structure.

These as well as other objects are accomplished by a construction process utilizing a construction frame to support an external facade, affixing a construction medium simulating the appearance of a solid stone to the construction frame, and then applying stucco around the construction medium and to the construction frame to give the appearance of the construction medium having been exposed due to the natural weathering of the stucco.

Other objects and a fuller understanding of the invention will become apparent from the following description given with reference to the accompanying drawings.

DETAILED DESCRIPTION

In accordance with this invention it has been found that a construction process can be provided which produces a structure simulating a desired appearance. It has also been found that such a construction process can produce a structure simulating the appearance of a solid stone structure with a weathered appearance. Further advantages and features will become apparent from a reading of the following description given with reference to the various figures of drawing.

Figure 1:
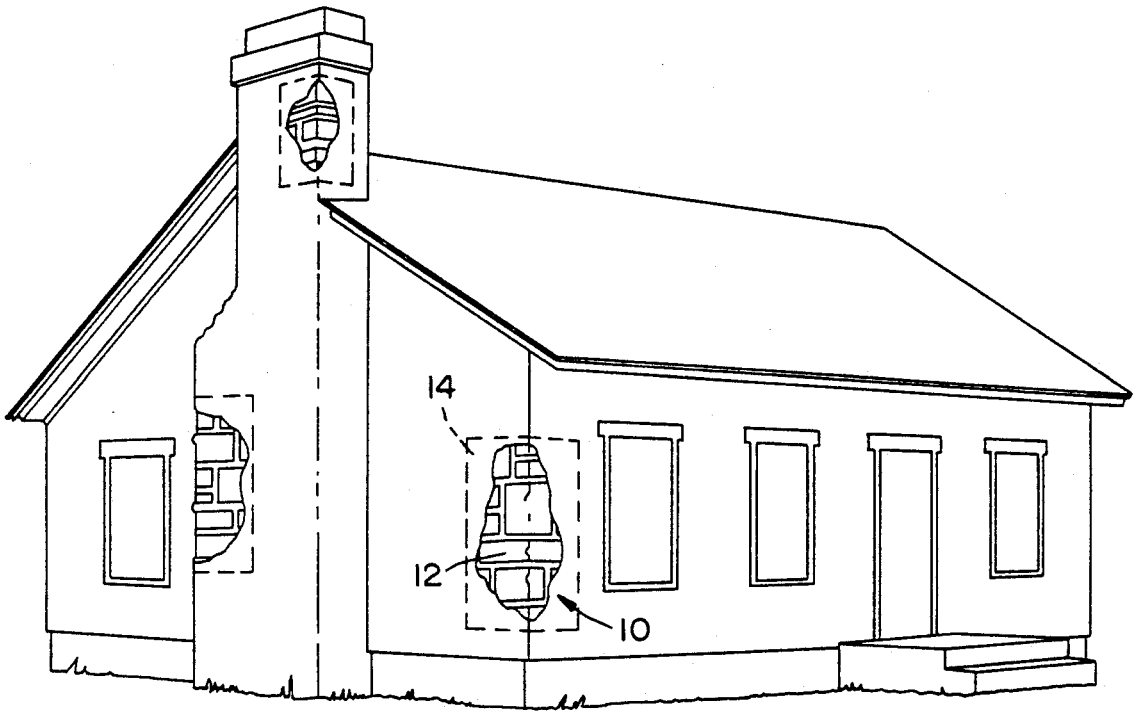
FIG. 1 is a perspective view of a house having corners with a surface section, of a construction medium simulating the appearance or solid stone affixed thereto.

FIG. 1 is a perspective view of a house with corners 10 having the appearance of weathered solid stone resulting from the construction process according to the present invention. As shown, the corners 10 comprise an exposed area of a construction medium 12 which simulates the appearance of solid stone. The construction medium 12 is affixed to and supported by a construction frame (not shown). Stucco 14 is shown applied around the construction medium 12 and to the construction frame to give the appearance of the construction medium 12 being exposed due to natural weathering of the stucco 14. This construction process is particularly suitable for corners 10, as illustrated in FIG. 1, but would also be appropriate on flat surfaces adjacent to doors, windows or other architectural features where investigation reveals that natural weathering and subsequent peeling of stucco to reveal underlying construction material would be most likely to occur.

Figure 2:
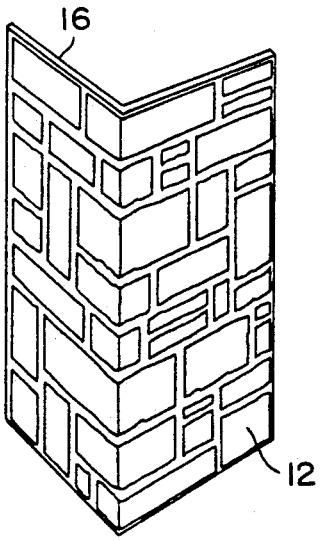
FIG. 2 is a perspective view of a construction frame having a surface section of a construction medium simulating the appearance of solid stone affixed thereto in accordance with this invention.

As seen in FIG. 2, the construction process in accordance with this invention includes the use of a construction frame 16. This construction process also includes placement of a surface section of a solid stone-simulating construction medium 12 simulating the appearance of solid stone to the construction frame 16. In a preferred embodiment, coquina is used as the construction medium 12. Construction frame 16 can be constructed of various conventional materials such as lumber, plywood, durock or particle board. The surface section of a construction medium simulating the appearance of solid stone can be applied by use of a man-made backing such as fiberglass to form an exposed area or areas of stone-simulating structure. FIG. 2 illustrates only one assembly of a construction frame 16 with a construction medium 12 affixed to it. It is also contemplated within this invention that various shapes of construction frames 16 can be used, and various methods for affixing a construction medium 12 to a construction frame 16 may be utilized.

The construction process in accordance with this invention comprises providing a construction frame 16 (shown in FIG. 2) and affixing a surface section of a construction medium 12 simulating the appearance of solid stone to the construction frame 16. Referring to figure stucco 14 is then applied around the construction medium 12 without totally covering the construction medium 12. This gives the appearance of the construction medium 12 being exposed due to the natural weathering of the stucco 14. This produces a structure 10 that has every outward appearance of being constructed of solid stone and being naturally weathered. The corners 10 are an example of only one shape and size, as this construction process can provide structures of various sizes and shapes which can be used as building structures.

It is thus seen that the invention provides a novel construction process for simulating a desirable appearance. It is further seen that the present invention provides a construction process for simulating the appearance of a stone structure with a natural weathered appearance. The construction process according to this invention also produces such a structure which can be used as a building structure for construction. Many variations are apparent to those of skill in the art, and such variations are embodied within the spirit and scope of the present invention as measured by the following appended claims.

That which is claimed:

1. A construction process to simulate a desirable appearance, comprising:

providing a construction frame to support an external facade;

affixing to said construction frame a surface section of a construction medium simulating the appearance of solid stone;

applying stucco on the outer surface and around said section without totally covering said section to give the appearance of stucco having peeled away from said section during a natural weathering process.

2. The process according to claim 1 wherein said stone is coquina.

3. The process according to claim 1 wherein said stone is adobe brick.

* * * * *